US009580978B2

(12) United States Patent
Bisel

(10) Patent No.: US 9,580,978 B2
(45) Date of Patent: Feb. 28, 2017

(54) ROD ELEVATOR

(71) Applicant: Neal O. Bisel, Okeene, OK (US)

(72) Inventor: Neal O. Bisel, Okeene, OK (US)

(73) Assignee: FBJ Tools, LLC, Elmore City, OK (US)

( * ) Notice: Subject to any disclaimer, the term of this patent is extended or adjusted under 35 U.S.C. 154(b) by 0 days.

(21) Appl. No.: 14/986,889

(22) Filed: Jan. 4, 2016

(65) Prior Publication Data

US 2016/0115745 A1 Apr. 28, 2016

Related U.S. Application Data

(63) Continuation of application No. 13/796,225, filed on Mar. 12, 2013, now abandoned.

(51) Int. Cl.
*E21B 19/06* (2006.01)

(52) U.S. Cl.
CPC ..... *E21B 19/06* (2013.01)

(58) Field of Classification Search
CPC ..... E21B 19/06
See application file for complete search history.

(56) References Cited

U.S. PATENT DOCUMENTS 580,737 A 4/1897 Smith
815,723 A 3/1906 Mahoney
1,535,625 A 4/1925 O'Bannon
1,545,377 A 7/1925 Westmoreland
1,709,234 A 4/1929 Shaffer
1,766,920 A 6/1930 Moody
2,054,223 A 9/1936 Le Bus
2,997,327 A 8/1961 Bjalme
3,063,509 A 11/1962 Guier
3,308,970 A 3/1967 Wilson et al.
3,734,181 A * 5/1973 Shaffer ..... E21B 41/02 166/65.1
4,035,012 A 7/1977 Guier
4,483,564 A 11/1984 McDaniel
4,522,439 A 6/1985 Haney
7,216,717 B2 5/2007 Severin et al.

OTHER PUBLICATIONS

Leslie V. Langston, "Well Servicing and Workover", *The Lease Pumper's Handbook*, Chapter 17, Section B, First Edition 2003, Commission on Marginally Producing Oil and Gas Wells of Oklahoma.

* cited by examiner

*Primary Examiner* — Giovanna C Wright
(74) *Attorney, Agent, or Firm* — Dunlap Codding, P.C.

(57) ABSTRACT

A rod elevator including a first latching mechanism and a second latching mechanism connected to one another in a spaced apart relationship for connecting a pair of rods to one another in an axially aligned relationship. Each of the latching mechanisms has a rod receiving space axially aligned with a rod receiving space of the other latching mechanism.

1 Claim, 8 Drawing Sheets

ROD ELEVATOR

CROSS-REFERENCE TO RELATED APPLICATION

The present application is a continuation of U.S. Ser. No. 13/796,225, filed Mar. 12, 2013, the entirety of which is hereby expressly incorporated herein by reference.

BACKGROUND OF THE INVENTION

In the production of hydrocarbons from subsurface formations, it is common to use a sucker rod to lift fluids to the surface. Typical sucker rod pumps include a string of sucker rods extending from the earth's surface down to a downhole pump. A pump jack located on the surface is employed to reciprocate the sucker rod string and thus the downhole pump. The pump jack typically is a beam that pivots in a vertical plane and which is provided with a horse head at one end. The horse head supports a pair of bridle cables and a carrier bar.

A polished rod is suspended from the carrier bar and extended through a stuffing box. The lower end of the polished rod is attached to the upper end of the sucker rod string. The polished rod has a polished exterior surface to serves to form a seal with the stuffing box and thus force formation fluid that is lifted to the earth's surface to flow from production tubing to a collection conduit by which the produced fluid is conveyed to a tank battery, pipeline or other system whereby the produced fluid is collected.

The sucker rod string is formed of a series of individual sucker rods which are connected to one another in an end-to-end fashion so as to work together to lift the fluid from the ground. At times, the need arises to service the well or replace or maintenance the downhole pump. To do so requires the sucker rod string be removed from the well.

Removal of the sucker rod string starts with the removal of the polished rod. Because polished rods are manufactured with a smooth, polished shaft having a uniform diameter, a pony rod is typically attached to the upper end of the polished rod to provide a location at which a rod elevator can be attached. Pony rods are provided with a recessed section consisting of a smaller diameter than the diameter at its ends. This recessed section allows the rod elevator to be attached to the pony rod so that the rod string can be lifted from the well.

After the polished rod is lifted and detached from the sucker rod string, the remaining sucker rods in the rod string are removed without the assistance of a pony rod because the sucker rods have a latching area for the rod elevator. Thus, only the polished rod requires the use of the pony rod to facilitate its removal from the rod string. Conventional rod elevators include a C-shaped or U-shaped body defining a rod receiving space. Two latch members are pivotally attached to the body to close on a rod automatically to securely lock the rod within the body. The rod can be released by thumb and finger pressure at either the front or rear of the body. A bail is connected to the body. The bail is a generally arched structure to permit the rod elevator to be suspended from a hook.

In practice, the rod elevator is suspended from a hook that is attached to the traveling block of a block and tackle assembly (i.e., an external hoist). During the process of connecting the rod elevator to the polished rod, the traveling block is typically positioned near the horsehead of the pump jack. Depending on the position of the horsehead and the traveling block, a problem may be encountered connecting the rod elevator to the polished rod due to contact between the horsehead and the traveling block interfering with the positioning of the rod elevator on the polished rod. For the foregoing reasons, there is a need for an apparatus that prevent contact between the horsehead and traveling block thereby facilitating a safe and efficient positioning of the rod elevator on the polished rod.

BRIEF DESCRIPTION OF THE DRAWINGS

FIG. 6 B is a front elevational view of an arm of the rod elevator of FIG. 3.

DETAILED DESCRIPTION OF EXEMPLARY EMBODIMENTS

Figure 1:
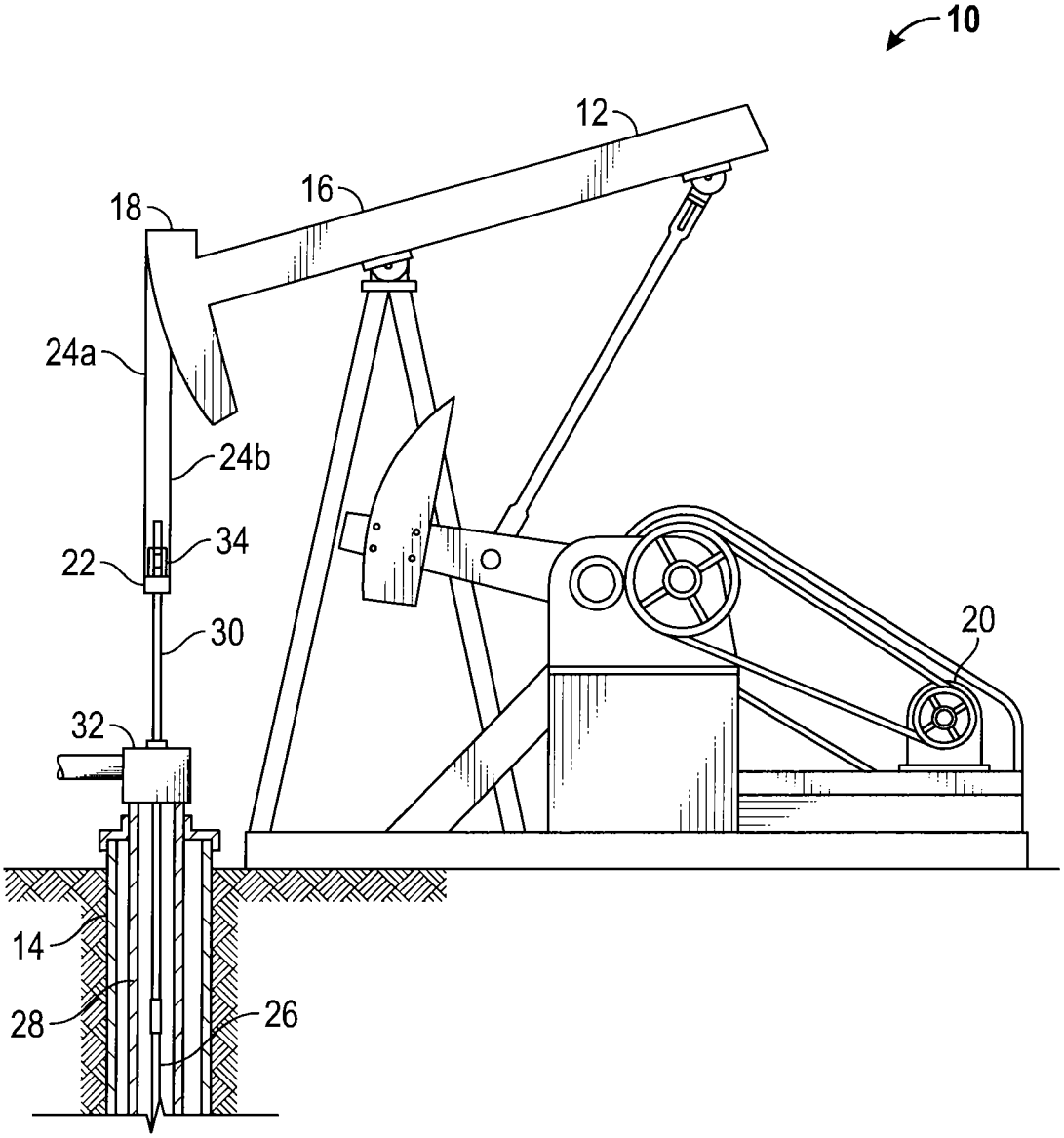
FIG. 1 (Prior Art)
FIG. 1 is an elevation view of a prior art pumping unit.

Before explaining at least one embodiment of the presently disclosed and claimed inventive concepts in detail, it is to be understood that the presently disclosed and claimed inventive concepts are not limited in their application to the details of construction, experiments, exemplary data, and/or the arrangement of the components set forth in the following description or illustrated in the drawings. The presently disclosed and claimed inventive concepts are capable of other embodiments or of being practiced or carried out in various ways. Also, it is to be understood that the phraseology and terminology employed herein is for purpose of description and should not be regarded as limiting.

Referring now to the drawings, and in particular FIG. 1, one version of a conventional beam pumping unit 10 is illustrated. The pumping unit 10 includes a pump jack 12 that drives a downhole reciprocating pump (not shown) located in a wellbore 14. The pump jack 12 has a walking beam 16 with a horsehead 18 located at one end. Activation of a primary mover 20 causes the horse head 18 to deliver a reciprocal pumping stroke to the downhole pump. A carrier bar 22 is suspended from bridle cables 24*a* and 24*b* which roll tangentially over the horse head 18 as it reciprocates. A string of sucker rods 26 is suspended from the carrier bar 22, and the sucker rod string 26 extends down production tubing 28 to drive the pump.

A polished rod 30 is connected to the top of the sucker rod string 26. The polished rod 30 extends through a stuffing box 32 and through the carrier bar 22. A rod clamp 34 is secured to the polish rod 30 above the carrier bar 22 to support the sucker rod string 26 while the weight is carried by the bridle cables 24*a* and 24*b* and the carrier bar 22.

Figure 2:
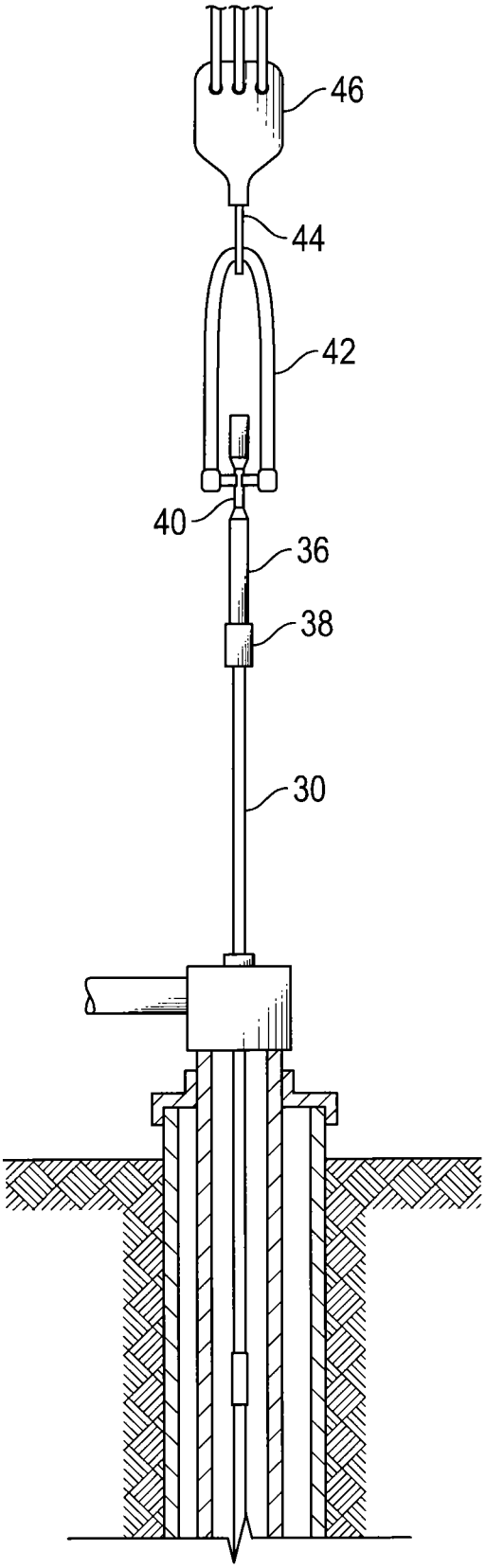
FIG. 2 (Prior Art)
FIG. 2 is an elevation view of the prior art pumping unit of FIG. 1 illustrating a pony rod with an area of reduced diameter attached to a polished rod.
Figure 3:
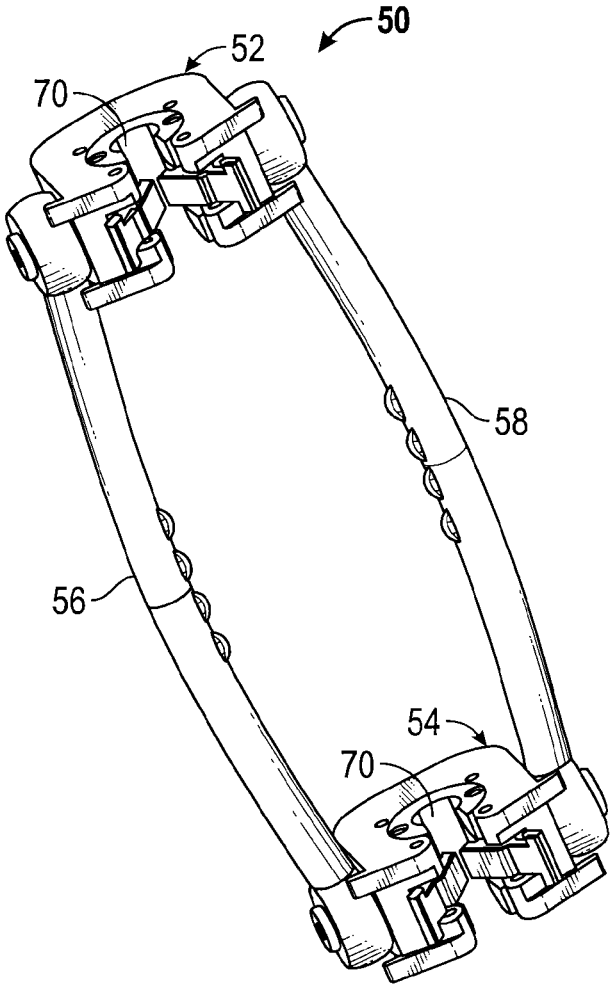
FIG. 3 is a front perspective view of a rod elevator constructed in accordance with the inventive concepts disclosed herein.
Figure 4:
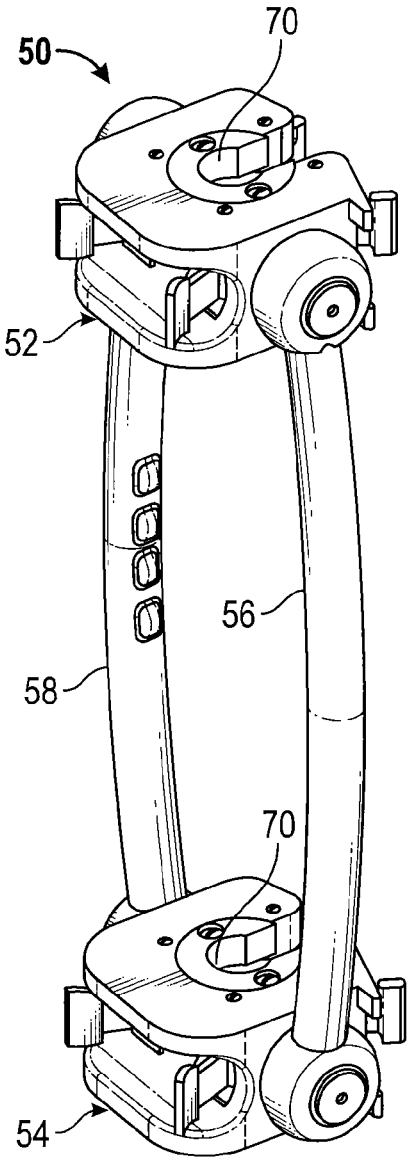
FIG. 4 is a rear perspective view of the rod elevator of FIG. 3.

Referring now to FIG. 2, one version of a pony rod 36 is shown connected to the upper end of the polished rod 30 with a coupler 38. The pony rod 36 includes a an area of reduced diameter or a recessed section 40. A rod elevator 42 which is supported by a rod hook 44 is shown latched to the pony rod 36 at the recessed section 40 of the pony rod 36. The rod hook 44 is connected to a traveling block 46. The traveling block 46, which is part of an external hoist system (not shown) is a movable unit consisting of sheaves or pulleys and moves up and down a derrick.

As discussed above, removal of the sucker rod string 26 from the well bore 14 entails disconnecting the carrier bar 22 and the rod clamp 34 from the polished rod 30 and attaching the pony rod 36 to the upper end of the polished rod 30 to allow the rod elevator 42 to be latched to the sucker rod string 26 and the traveling block 46 to be used to lift the sucker rod string 26 from the wellbore 14 so that the polished rod 30 may be disconnected from the remainder of the sucker rod string 26. As will be appreciated, the process of connecting the rod elevator 42 to the polished rod 30 can be cumbersome, inefficient, and sometimes hazardous because the position of the horsehead 18 can result in contact between the traveling block 46 and the horsehead 18 which can preclude safe and efficient access to the polished rod 30.

Referring now to FIGS. 3-7, an exemplary embodiment of a rod elevator 50 constructed in accordance with the inventive concepts disclosed herein is illustrated. The rod elevator 50 includes a first latching mechanism 52 and a second latching mechanism 54 connected to one another in a spaced apart relationship with a pair of arms 56 and 58. An exemplary use of the rod elevator 50 for pulling the polished rod 30 will be described below with reference to FIG. 7. The first latching mechanism 52 and the second latching mechanism 54 may be substantially identical in construction. As such, only the first latching mechanism 52 will be described in detail below.

Figure 5:
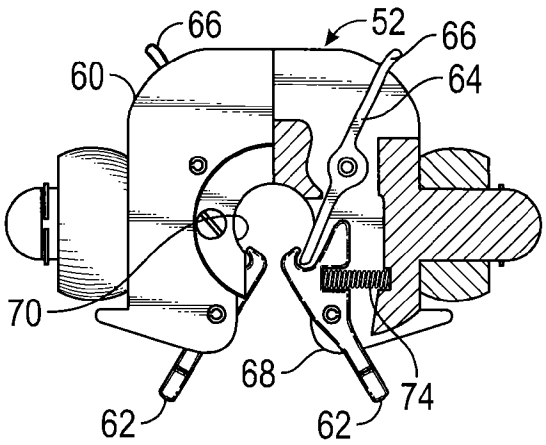
FIG. 5 is a partially cut away, top plan view of a prior art latching the rod elevator of FIG. 3.
Figure 6A:
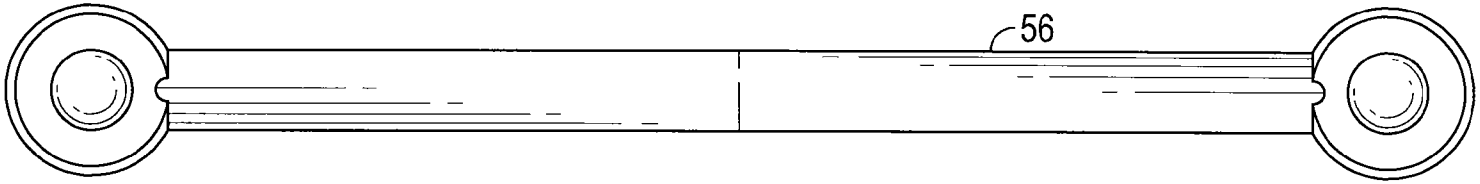
FIG. 6 A is a side elevational view of an arm of the rod elevator of FIG. 3.
Figure 6B:
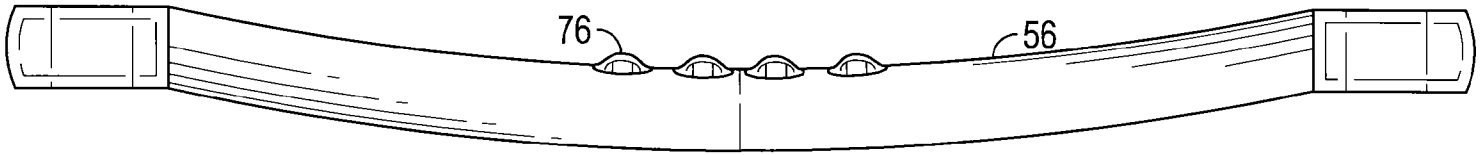

As best illustrated in FIG. 5, the first latching mechanism 52 includes a body 60, a pair of latch members 62, and a pair of release levers 64 terminating in a first pair of finger pieces 66. The body 60 is generally C-shaped member defining a notch 68. The notch 68 defines a rod receiving space 70. The latch members 62 are pivotally attached to the body 60 in such a way that the latch members 62 extend from the body 60 into the rod receiving space 70 for releasably retaining a rod in the rod receiving space 70 in a manner to be discussed below.

The first latching mechanism 52 may include a spring 74 positioned for biasing the latch members 62 in a latching position (FIG. 5). The latch members 62 may be moved to a rod release position by pressing the finger pieces 66 of the levers 64 together so as to cause the latch members 62 to move away from one another to permit the rod to be removed from the rod receiving space 70.

The first latching mechanism 52 described and illustrated herein is similar in construction to the latching mechanism disclosed in U.S. Pat. No. 1,535,625, which is hereby expressly incorporated herein by reference. However, it should be appreciated by those of ordinary skill in the art that latching mechanisms are well known in the art and that the latching mechanisms 52 and 54 may take a variety of forms so long as the latching mechanisms are capable of supporting a rod.

With reference to FIGS. 3, 4, 6A, and 6B, the first latching mechanism 52 and the second latching mechanism 54 are connected to opposing ends of the arms 56 and 58. The first latching mechanism 52 and the second latching mechanism 54 may be connected to the ends of the arms so that the latching mechanisms 52 and 54 may pivot relative to the arms 56 and 58. In one embodiment, the first latching mechanism 52 and the second latching mechanism 54 are each pivotally connected to the arms 56 and 58 in such a way that the latching mechanisms 52 and 54 may be rotated 360 degrees relative to the arms 56 and 58.

The arms 56 and 58 are elongated rigid members which may be constructed in a variety of shapes and lengths so long as the lengths of the arms 56 and 58 create a sufficient distance between the latching mechanisms 52 and 54 that when two rods are positioned in the rod receiving spaces 70, the rods are linked to one another without requiring threaded engagement. In one embodiment, the arms 56 and 58 may be shaped such that the arms bow outwardly relative to the first latching mechanism 52 and the second latching mechanism 54. The arms 56 and 58 may also be provided with finger grips 76 to facilitate handling of the rod elevator 50.

As will be described below, the first latching mechanism 52 and the second latching mechanism 54 are connected in a spaced apart relationship with the first rod receiving space 70 of the first latching mechanism 52 substantially aligned with the second rod receiving space 70 of the second latching mechanism 54 such that when a first rod is positioned in the first rod receiving space 70 of the first latching mechanism 52 and a second rod is positioned in a second rod receiving space 70 of the second latching mechanism 54, the first rod and the second rod are substantially axially aligned. The rod elevator 50 further allows the first and second rods to be connected to one another without requiring direct contact between the rods. By way of example, the rod elevator 50 allows various types of rods with damaged threads to be connected to one another.

Figure 7:
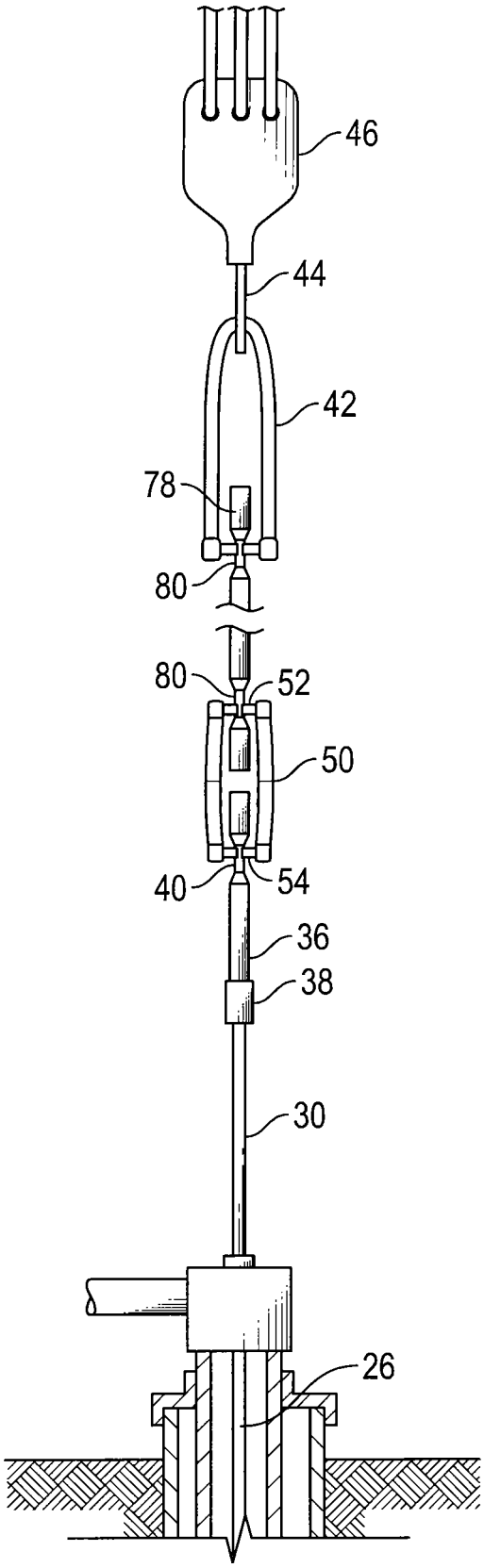
FIG. 7 is an elevational view of a polished rod shown suspended from the rod elevator of FIG. 3.

Referring now to FIG. 7, the rod elevator 50 may be used to pull a sucker rod string, such as the sucker rod string 26 described above. In use, a conventional rod elevator 42 is suspended from the traveling block 46 with the rod hook 44. A rod 78 may then be suspended from the conventional rod elevator 42. The rod 78 may be a sucker rod having areas of reduced diameter 80 (i.e., a latching sections) on each end of the rod 78. In one version, the rod 78 may have a diameter that allows the rod 78 to be received in a vertical slot (not shown) of the horsehead 18. Next, the first latching mechanism 52 of the rod elevator 50 may be connected to the lower end of the rod 78 by inserting the area of reduced diameter 80 of the rod 78 past the first pair of latch members 62 and into the first rod receiving space 70. Finally, the second latching mechanism 54 may be connected to the pony rod 36 by inserting the area of reduced diameter 80 of the pony rod 36 past the second pair of latching members 62 and into the second rod receiving space 70, whereby the rod 78 and the pony rod 36 are substantially axially aligned. The rod elevator 50 enables the rod 78 to be connected to the upper end of the rod elevator 50 so as to create an extension that enables connection with the pony rod 36 while maintaining the traveling block 46 in a position above the horsehead 18 so that the traveling block 46 does not come into contact with the horsehead 18.

The rod elevator 50 has been described above as being used to make a connection between a hoist assembly and a pony rod. However, it should be appreciated that second latching mechanism 54 can be attached to any type of a rod with a recessed section or an area of reduced diameter. For example, the second latching mechanism 54 could be connected directly to a polished rod which includes a latching section, such as that disclosed in U.S. patent application Ser. No. 13/206,170, which is hereby expressly incorporated herein by reference.

Figure 8:
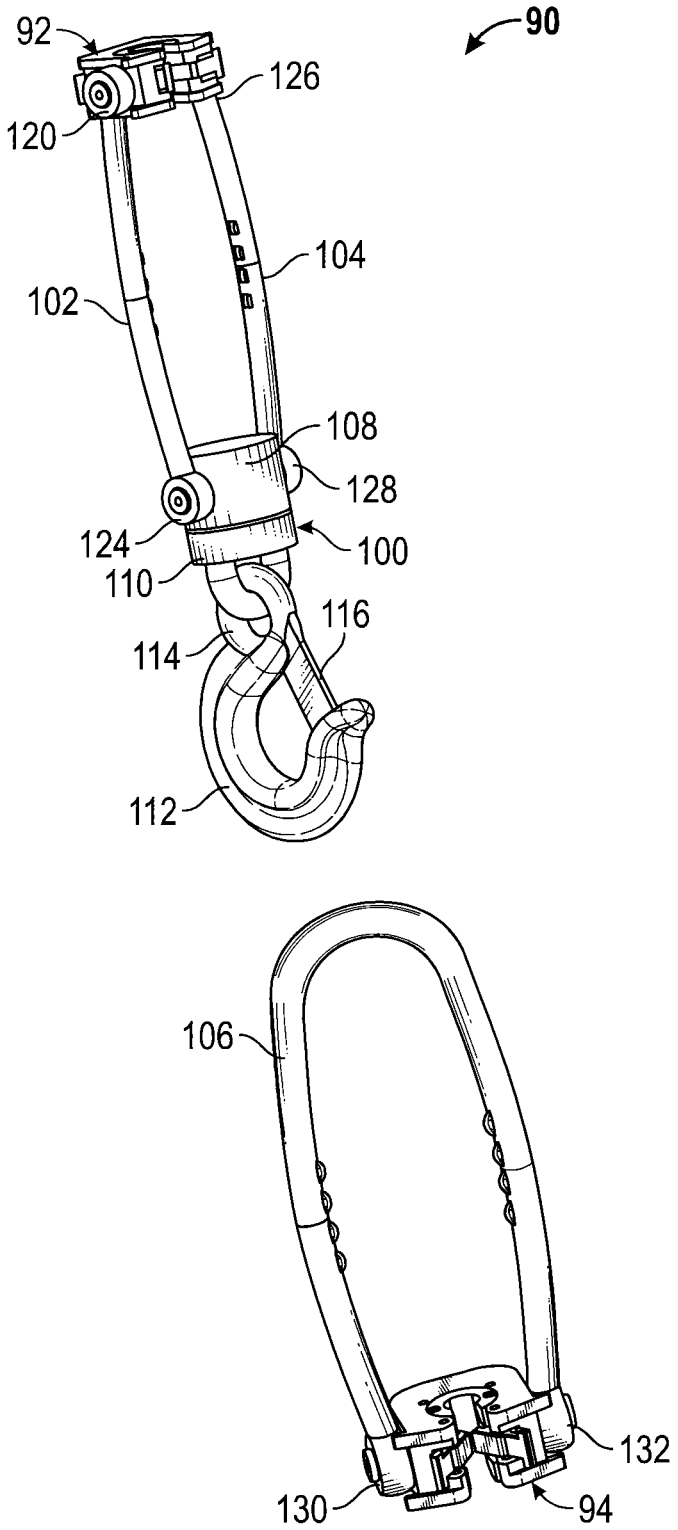
FIG. 8 is an exploded front perspective view of another embodiment of a rod elevator constructed in accordance with the inventive concepts disclosed herein.
Figure 9:
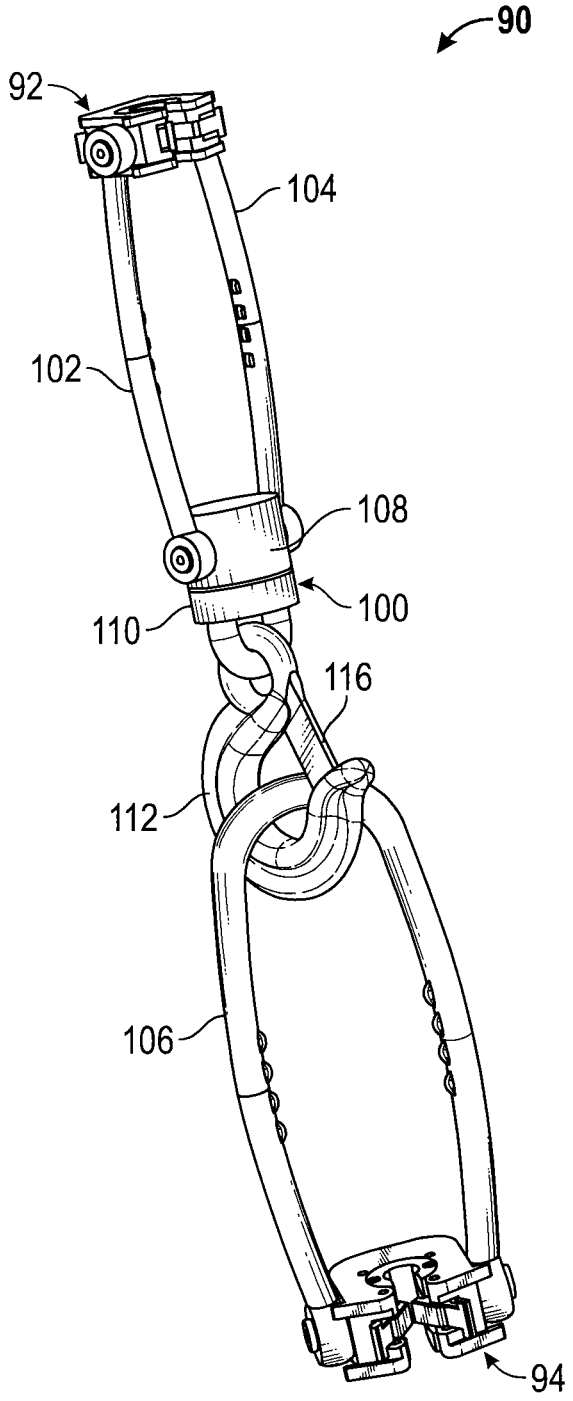
FIG. 9 is a front perspective view of the rod elevator of FIG. 8.
Figure 10:
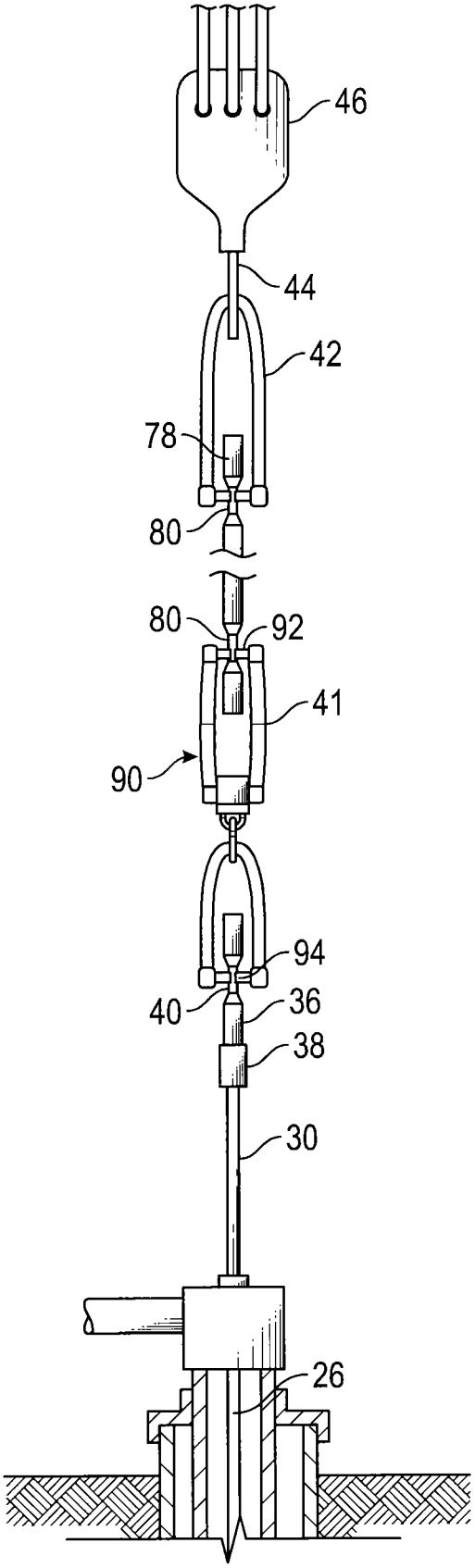
FIG. 10 is an elevational view of a polished rod shown suspended from the rod elevator of FIGS. 8 and 9.

Referring now to FIGS. 8-10, another embodiment of a rod elevator 90 constructed in accordance with the inventive concepts disclosed herein is illustrated. Similar to the rod elevator 50 described above, the rod elevator 90 includes a first latching mechanism 92 and a second latching mechanism 94 which are connected to one another in a spaced apart relationship. An exemplary use of the rod elevator 90 for pulling the polished rod 30 will be described below with reference to FIG. 10.

The first latching mechanism 92 and the second latching mechanism 94 of the rod elevator 90 may be constructed in a manner similar to the latching mechanisms 52 and 54 described above. To connect the first latching mechanism 92 and the second latching mechanism 94, the rod elevator 90 further includes a hook assembly 100, a first arm 102, a second arm 104, and an arched structure 106.

The hook assembly includes a base 108, a swiveled eye 110, and a J-shaped hook body 112, which is connected to the swiveled eye 110 by an eyelet 114 of the hook body 112. Pivotally connected to the area where the eyelet 114 and the hook body 112 connect is a tongue 116 that extends across the throat of the hook body 112 terminating where the tongue 116 meets the free end of hook body 118. The hook 112 is connected to the base 108 in a way that allows the hook to rotate 360 degrees relative to the base 108.

The first arm 102 and the second arm 104 are constructed in a manner similar to that described above and illustrated in FIG. 6A and FIG. 6B. A first end 120 of the first arm 102 is pivotally attached to the first latching mechanism 92, and a second end 124 of the first arm 102 is pivotally attached to the hook assembly 100. Likewise, a first end 126 of the second arm 104 is pivotally attached to the latching mechanism 92, and the second end 128 of the second arm 104 is pivotally attached to the hook assembly 100.

The arched structure 106 has a first free end 130 pivotally attached to the body of the second latching mechanism 94 and a second free end 132 pivotally attached to the second latching mechanism 94. The arched structure 106 is also detachably connected to the hook assembly 100 where it may be retained by the tongue 116 of the hook assembly 100.

Referring now to FIG. 10, the rod elevator 90 may be used to pull a sucker rod string, such as the sucker rod string 26 described above. In use, a conventional rod elevator 42 is suspended from the traveling block 46 with the rod hook 44. A rod 78 may then be suspended from the conventional rod elevator 42. The rod 78 may be a sucker rod having areas of reduced diameter 80 (i.e., a latching sections) on each end of the rod 78. In one embodiment, the rod 78 may have a diameter that allows the rod to be received in a slot (not shown) of the horsehead 18. Next, the first latching mechanism 92 of the rod elevator 90 may be connected to the lower end of the rod 78 by inserting the area of reduced diameter 80 of the rod 78 into the first rod receiving space of the first latching mechanism 92. Finally, the second latching mechanism 94 may be connected to the pony rod 36 by inserting the area of reduced diameter 80 of the pony rod 36 into the rod receiving space of the second latching mechanism 94, whereby the rod 78 and the pony rod 36 are substantially axially aligned. The rod elevator 90 enables a rod to be connected to the upper end of the rod elevator 90 so as to create an extension that enables connection with the pony rod 36 while maintaining the traveling block 46 in a position above the horsehead 18 so that the traveling block 46 does not come into contact with the horsehead 18.

The rod elevator 90 has been described as being used to make a connection between a hoist assembly and a pony rod. However, it should be appreciated that second latching mechanism 94 can be attached to any type of a rod with a recessed section or an area of reduced diameter. For example, the second latching mechanism 94 could be connected directly to a polished rod with a latching section as described in U.S. patent application Ser. No. 13/206,170, which is hereby expressly incorporated herein by reference.

From the above description, it is clear that the present inventive concept is well adapted to carry out the objects and to attain the advantages mentioned herein as well as those inherent in the invention. While exemplary embodiments of the invention have been described for purposes of this disclosure, it will be understood that numerous changes may be made which will readily suggest themselves to those skilled in the art and which are accomplished within the spirit of the inventive concept disclosed and claimed herein.

What is claimed is:

1. A method of pulling a sucker rod string from a well bore, the sucker rod string suspended from a horsehead of a pump jack, the sucker rod string having a polished rod extending through a stuffing box and a pony rod extending from an upper end of the polished rod, the pony rod having an area of reduced diameter, the method comprising:

obtaining a rod elevator comprising:

a first latching mechanism having a first body and a first pair of latch members, the first body provided with a first notch on one side thereof, the first notch defining a first rod receiving space, the first pair of latch members pivotally attached to the first body and extending from the first body into the first rod receiving space; and a second latching mechanism having a second body and a second pair of latch members, the second body provided with a second notch on one side thereof, the second notch defining a second rod receiving space, the second pair of latch members pivotally attached to the second body and extending from the second body into the second rod receiving space;

wherein the first latching mechanism is connected to the second latching mechanism in a spaced apart relationship with the first rod receiving space of the first latching mechanism substantially aligned with the second rod receiving space of the second latching mechanism;

interconnecting an additional rod to a traveling block of a hoist system, the additional rod having an area of reduced diameter on at least a lower end thereof; connecting the first latching mechanism to the lower end of the additional rod by inserting the area of reduced diameter of the additional rod into the first rod receiving space of the first latching mechanism;

connecting the second latching mechanism to the pony rod by inserting the area of reduced diameter of the pony rod into the second rod receiving space of the second latching mechanism so that the additional rod and the pony rod are in a spaced apart, axially aligned relationship, wherein the additional rod has a length such that the traveling block is maintained above the horsehead in a non-contact relationship thereto.

* * * * *